US008958578B2

(12) United States Patent
Chen

(10) Patent No.: US 8,958,578 B2
(45) Date of Patent: Feb. 17, 2015

(54) THROAT VIBRATION AUDIO WIRELESS TRANSMISSION APPARATUS

(71) Applicant: Yi Chuan Chen, New Taipei (TW)

(72) Inventor: Yi Chuan Chen, New Taipei (TW)

( * ) Notice: Subject to any disclaimer, the term of this patent is extended or adjusted under 35 U.S.C. 154(b) by 77 days.

(21) Appl. No.: 13/933,584

(22) Filed: Jul. 2, 2013

(65) Prior Publication Data

US 2015/0010172 A1 Jan. 8, 2015

(51) Int. Cl.

| | |
|---|---|
| ***H04R 25/00*** | (2006.01) |
| ***H04R 9/08*** | (2006.01) |
| ***H04R 11/04*** | (2006.01) |
| ***H04R 17/02*** | (2006.01) |
| ***H04R 19/04*** | (2006.01) |
| ***H04R 21/02*** | (2006.01) |
| ***H04R 1/46*** | (2006.01) |

(52) U.S. Cl.
CPC ..... *H04R 1/46* (2013.01)
USPC ..... 381/151; 381/364

(58) Field of Classification Search
CPC ..... H04R 1/14; H04R 1/46; H04R 2460/13; A61B 5/4205; A61B 5/6822
USPC ..... 381/124, 151, 364, 385; 600/300, 586, 600/587, 590
See application file for complete search history.

(56) References Cited

U.S. PATENT DOCUMENTS

| | | | | |
|---|---|---|---|---|
| 4,607,383 | A * | 8/1986 | Ingalls | 381/113 |
| 2001/0012373 | A1* | 8/2001 | Graumann | 381/364 |
| 2009/0030346 | A1* | 1/2009 | Kojima et al. | 600/590 |
| 2011/0051944 | A1* | 3/2011 | Kirkpatrick | 381/70 |
| 2013/0310661 | A1* | 11/2013 | Jedwab et al. | 600/301 |

FOREIGN PATENT DOCUMENTS

| | | |
|---|---|---|
| TW | 458479 | 10/2001 |

* cited by examiner

*Primary Examiner* — Matthew Eason
(74) *Attorney, Agent, or Firm* — Muncy, Geissler, Olds & Lowe, P.C.

(57) ABSTRACT

A throat vibration audio wireless transmission apparatus comprises a body, a throat vibration detection module and a wireless transmission module. The body includes a cap, a flexible base and a deformation holding member. The cap has multiple cover portions and at least one elastic bending portion bridging two neighboring cover portions. The deformation holding member can be pushed by forces to form an arched shape and drive the flexible base and cap to bend to allow the elastic bending portion to extend towards the cover portions at two sides thereof. The throat vibration detector detects a vibration wave and converts to an electric signal. The control circuit board receives the electric signal and converts to an audio signal which is then transmitted by the wireless transmission module. The apparatus can be adjusted according to a user's neck and attached thereon closely to receive sound without being interfered by environment.

8 Claims, 4 Drawing Sheets

THROAT VIBRATION AUDIO WIRELESS TRANSMISSION APPARATUS

FIELD OF THE INVENTION

The present invention relates to a throat vibration microphone and particularly to a throat vibration audio wireless transmission apparatus.

BACKGROUND OF THE INVENTION

With increasing popularity of consumer electronic products such as smartphones, Personal Digital Assistant (PDA) and the like, incorporated with usage in various occasions such as work and exercises, many different types of microphone devices have been developed and marketed. For instance, to facilitate listening during vehicle driving or riding ear-hook microphones have been invented. The ear-hook microphones mostly receives sound by the capacitance sound receiving manner which treat air as medium to receive sound generated from a sound source. However, due to the noises of environment also can be received by the microphone through the air, the quality of sound received is not desirable, and noises are easily generated to impair the sound clarity.

To resolve the aforesaid problem, Taiwan Patent No. 458479 discloses a throat cavity sound-controlled piezoelectric microphone for mobile phones. It comprises a piezoelectric microphone, a metal elastic neck bracket and an earphone. The piezoelectric microphone is installed on one end of the metal elastic neck bracket and connected with the earphone through a transmission line. The piezoelectric microphone and earphone can be stretched outwards through a connection line to a desired length. The metal elastic neck bracket can be nipped on a user's neck to make the piezoelectric microphone be attached to the Adam's apple of the speaker to detect skin vibration caused by throat cavity resonance when the speaker is talking, and convert to electric signals through a piezoelectric fashion to block the ambient noises.

However, the aforesaid throat cavity sound-controlled piezoelectric microphone for mobile phones adopts a design with line connection. During carrying or use it is constrained by the length of the connection line and must be used at a short distance. Moreover, the connection line is easily entangled so that an extra line winding means is needed for retraction and storage the connection line to reduce the length thereof while in use, and also requires a greater care during stretching to avoid entangling. All this creates a lot of troubles for users.

In short, the conventional techniques still have a lot of drawbacks in terms of design and use. Adopted wireless transmission in the design of throat vibration microphone is a commendable approach to improve the usability and convenience and the focus of this invention.

SUMMARY OF THE INVENTION

The object of the present invention is to provide an apparatus which is adjustable according to a user's neck and attached directly thereon to receive sound to solve the problem of environmental interference.

To achieve the foregoing object the invention provides a throat vibration audio wireless transmission apparatus which comprises a body, a throat vibration detection module and a wireless transmission module installed in the body. The body includes a cap, a flexible base coupled with the cap and a deformation holding member on the flexible base. The cap has a plurality of cover portions and at least one elastic bending portion bridging two neighboring cover portions of the body. The deformation holding member includes a release state without bending by forces and a bending state in which the deformation holding member is pushed by forces to make two ends thereof move towards the center to form an arched shape. At the bending state the elastic bending portion drives the flexible base and the cap to bend to allow the elastic bending portion to extend towards the cover portions at two sides thereof, and the flexible base warps in a bend direction to drive the elastic bending portion to warp. The body is held at the bending state by the deformation holding member. On the other hand, the flexible base can also be bent opposite to the bend direction to retract the elastic bending portion and make the body in a horizontal placement position. The throat vibration detection module includes a throat vibration detector located at one end of the body and a control circuit board installed in the body and electrically connected to the throat vibration detector. The throat vibration detector can detect a vibration wave and convert to an electric signal. The control circuit board receives the electric signal and converts to an audio signal. The wireless transmission module is installed in the body and electrically connected to the control circuit board to transmit the sound signal.

In one embodiment the invention further includes a battery installed in the body to provide electric power to the control circuit board.

In another embodiment the body includes a Universal Serial Bus (USB) at another end opposite to the throat vibration detector to form electric connection with the control circuit board so that the throat vibration audio wireless transmission apparatus can be connected with an external electronic device.

In yet another embodiment the body includes an audio output port electrically connected to the control circuit board to get the audio signal.

In yet another embodiment the body holds at least one earphone electrically connected to the control circuit board for broadcasting.

In yet another embodiment the body contains at least one light emitting diode (LED) electrically connected to the control circuit board to provide light for purposes of alert and illumination.

In yet another embodiment the control circuit board includes a memory unit to store the audio signal.

In yet another embodiment the control circuit board is a flexible printed circuit board.

In short, the throat vibration audio wireless transmission apparatus of the invention mainly includes a body, a throat vibration detection module located at one end of the body and a wireless transmission module installed in the body. The body includes a cap, a flexible base coupled with the cap and a deformation holding member on the flexible base. The cap has a plurality of cover portions and at least one elastic bending portion bridging two neighboring cover portions. The deformation holding member can be pushed by forces to make two ends thereof move towards the center to form an arched shape and drive the flexible base and the cap to bend to allow the elastic bending portion to extend towards the cover portions at two sides thereof. The throat vibration detector of the throat vibration detection module detects a vibration wave and converts to an electric signal which is received by the control circuit board of the throat vibration detection module and converted to an audio signal transmitted by the wireless transmission module. The apparatus thus formed can be adjusted according to a user's neck and attached thereon closely to receive the sound so that the interference of environment can be reduced. The apparatus also can be moved and adjusted according to user's requirements or desired locations in a wireless fashion, which further improves the usability.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
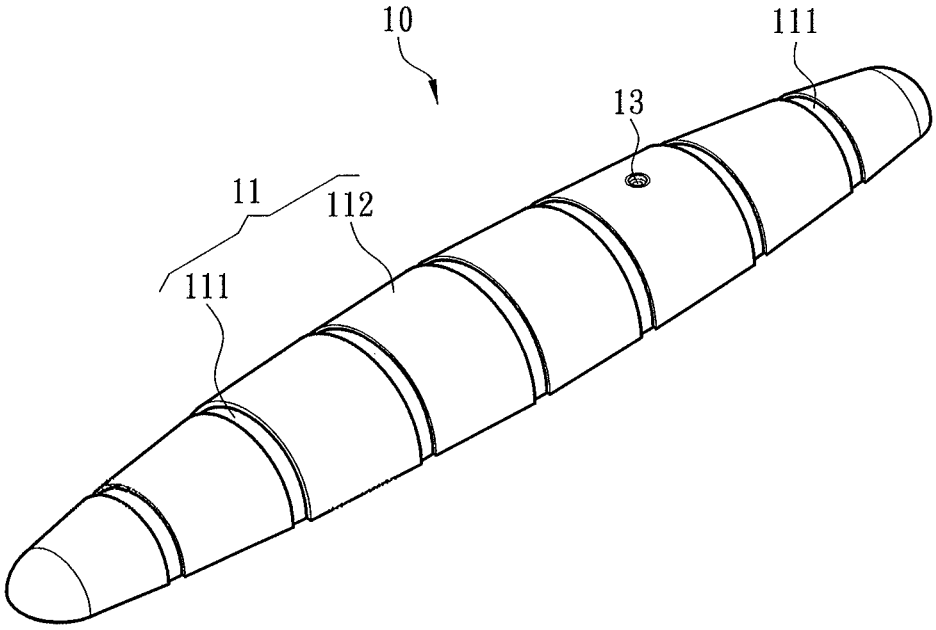
FIG. 1 is a perspective view of a first embodiment of the throat vibration audio wireless transmission apparatus of the invention.
Figure 2:
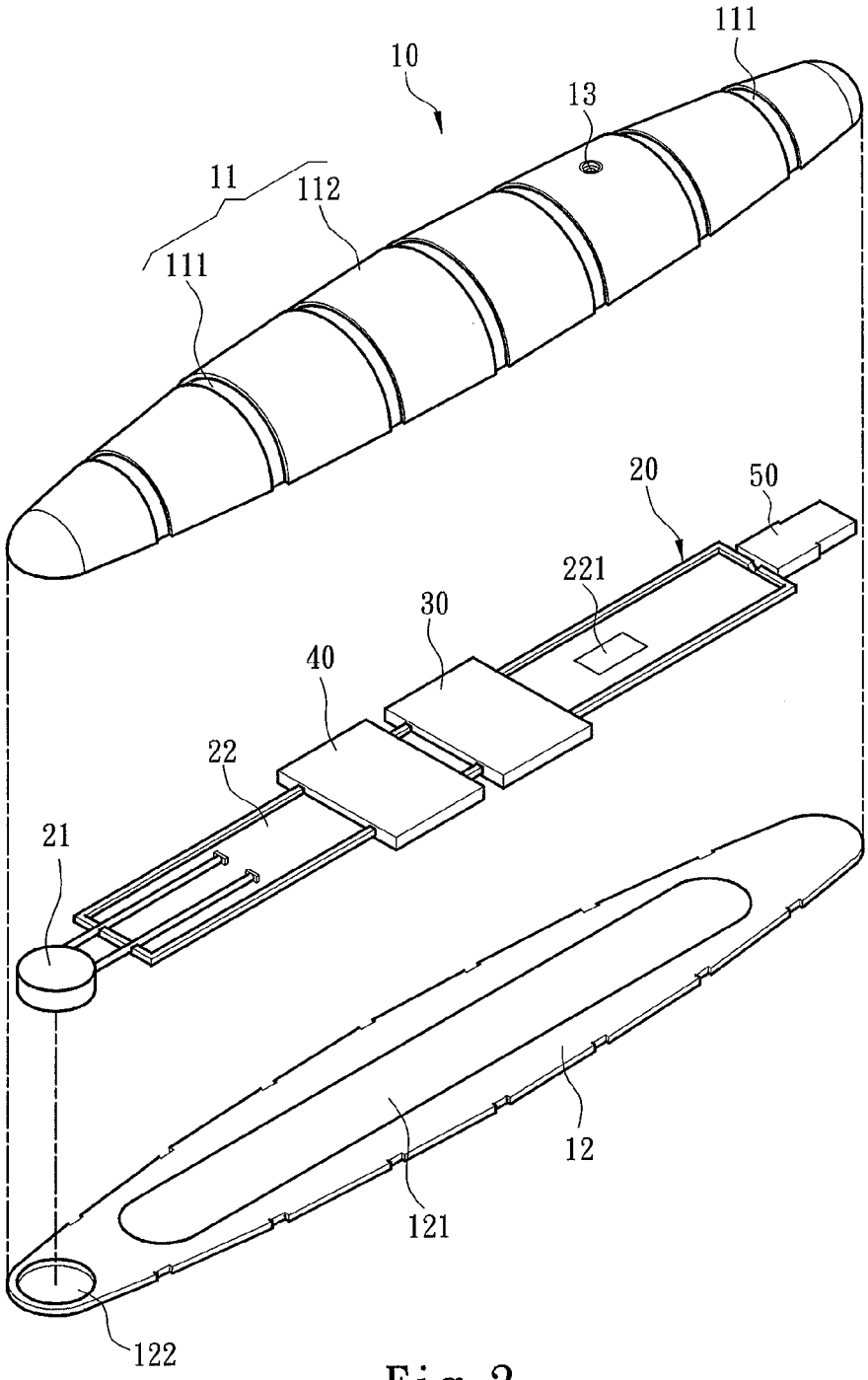
FIG. 2 is an exploded view of the first embodiment of the invention.
Figure 3:
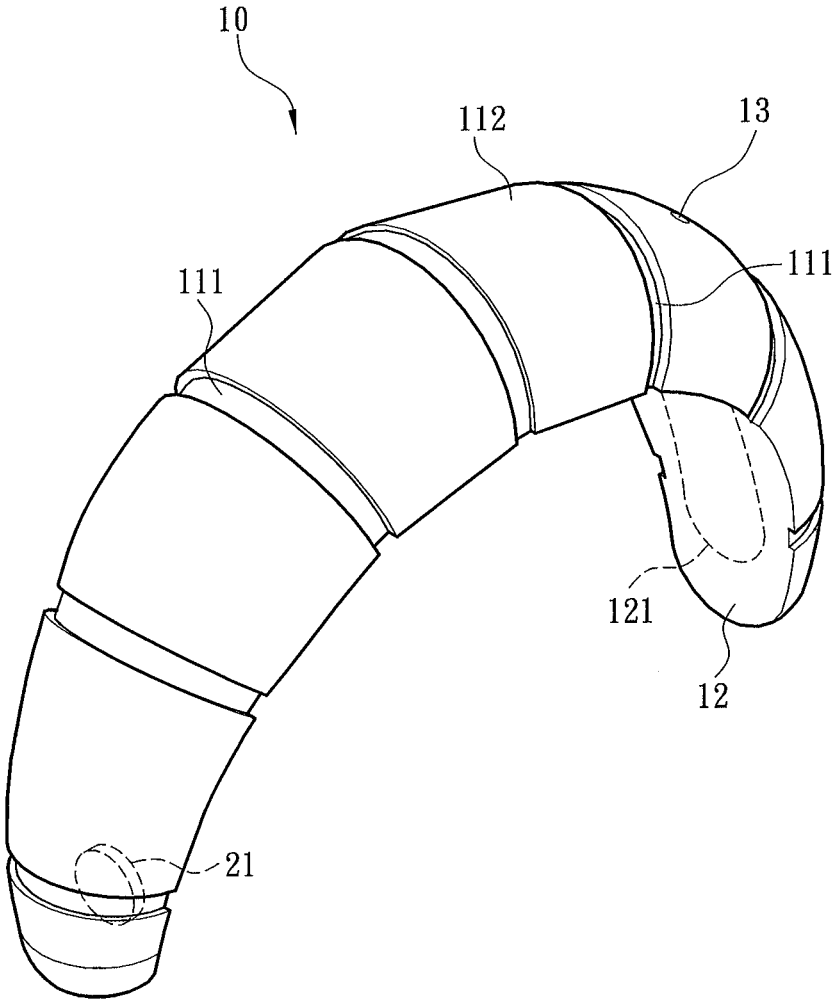
FIG. 3 is a schematic view of the first embodiment of the invention in a use condition.

Please refer to FIGS. 1, 2 and 3 for a first embodiment of the throat vibration audio wireless transmission apparatus of the invention. It comprises a body 10, a throat vibration detection module 20, a wireless transmission module 30 (such as Bluetooth) and a battery 40. The body 10 includes a cap 11 and a flexible base 12 coupled with the cap 11. The cap 11 includes a plurality of cover portions 112 and at least one elastic bending portion 111 bridging two neighboring cover portions 112. The elastic bending portion 111 is a flexible material (such as rubber). A deformation holding member 121 is on the flexible base 12 and has a perforation 122 formed thereon. The deformation holding member 121 is a flexible material (such as silicon rubber) and has a release state without receiving forces to bend and a bending state in which the deformation holding member 121 is pushed by forces to make two ends thereof move towards the center to form an arched shape. At the bending state, the deformation holding member 121 drives the flexible base 12 and the cap 11 to bend to allow the elastic bending portion 111 to extend towards the cover portions 112 at two sides thereof.

The throat vibration detection module 20 is installed in the body 10 and includes a throat vibration detector 21 and a control circuit board 22. The throat vibration detector 21 is located at one end of the body 10 and exposed through the perforation 122 to attach closely to the Adam's apple of a user. The control circuit board 22 is installed in the body 10 and electrically connected to the throat vibration detector 21 which detects a vibration wave and transform to an electric signal. The control circuit board 22 receives the electric signal and converts to an audio signal. The control circuit board 22 is a bendable flexible printed circuit board and includes a memory unit 221 to store any type of audio information (such as music, sound signals). The wireless transmission module 30 is installed in the body 10 and electrically connected to the control circuit board 22 to transmit the audio signal converted by the control circuit board 22. In addition, the body 10 also includes an audio output port 13 electrically connected to the control circuit board 22 to get the audio signal to an earphone connected externally (not shown in the drawings). The body 10 includes a USB 50 located at another end opposite to the throat vibration induction device 21. The USB 50 is electrically connected to the control circuit board 22 to allow the throat vibration audio wireless transmission apparatus to form electric connection with an external electronic device (not shown in the drawings) to save information or charge.

In this embodiment the cap 11 and base 12 are coupled by buckling. User can replace the cap 11 according to requirement. The elastic bending portion 111 of the cap 11 and deformation holding member 121 of the flexible base 12 are made by flexible material. As pervious discussed, the deformation holding member 121 has a release state and a bending state. At the release state the deformation holding member 121 does not receive forces to bend. At the bending state the deformation holding member 121 is pushed by forces to make two ends thereof move towards the center to form an arched shape, and drives the flexible base 12 and the cap 11 to bend to allow the elastic bending portion 111 to extend towards the cover portions 112 at two sides thereof (referring to FIG. 3), so that the body 10 is adjustable by the user according to the user's neck and closely attached thereon. The throat vibration detector 21 directly attached to the Adam's apple of the user detects vibration waves from the Adam's apple and converts to the electric signal which in turn is received by the control circuit board 22 and converted to the audio signal, then transmitted via the wireless transmission module 30 to a portable electronic device (such as a handset, not shown in the drawings). I.e., receiving sound through direct attaching the interference of environment can be reduced. Moreover, the wireless transmission approach also can resolve the limitation of the distance between the body 10 and the portable electronic device caused since the line transmission that occurs to the conventional techniques. User can move and adjust according to requirements or desired positions in the wireless transmission fashion which greatly improves the usability and convenience.

Moreover, the memory unit 221 of the control circuit board 22 can save audio information such as music and sound signals. The audio output port 13 at the body 10 can be connected to an external earphone (not shown in the drawings) according to user's desire, so that the throat vibration audio wireless transmission apparatus can serve as a multimedia player, such as a MP3 player. In addition, the USB 50 at the opposite end of the throat vibration detector 21 allows the throat vibration audio wireless transmission apparatus to be connected electrically to an external electronic device (such as a computer, not shown in the drawings) to transmit the audio information to the external electronic device or save other information in the memory unit 221, or provide other functions such as charging the battery 40.

Figure 4:
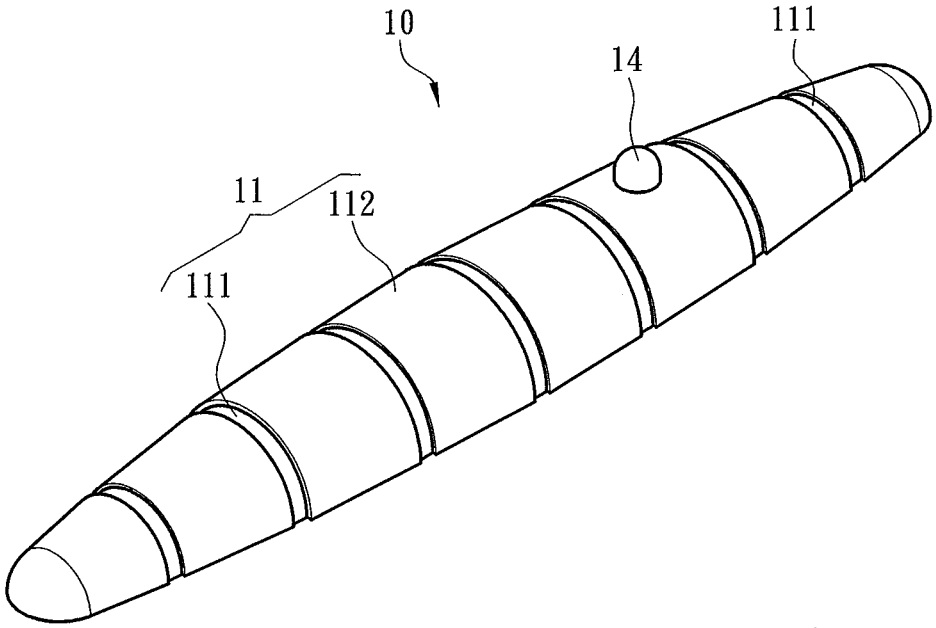
FIG. 4 is a perspective view of a second embodiment of the throat vibration audio wireless transmission apparatus of the invention.

Please refer to FIG. 4 for a second embodiment of the invention. It is substantially constructed like the first embodiment previously discussed. The main difference is that the body 10 includes at least one earphone 14 directly installed thereon to form electrical connection with the control circuit board 22 to broadcast sound (such as music). The wire of the earphone 14 is held in the body 10 by a holding tool such as a line winder (not shown in the drawings). It is to be noted that the number and embodiment type of the earphone 14 is not limited to what has been mentioned above. The embodiment previously discussed serves merely for illustrative purpose and is not the limitation of the invention.

Figure 5:
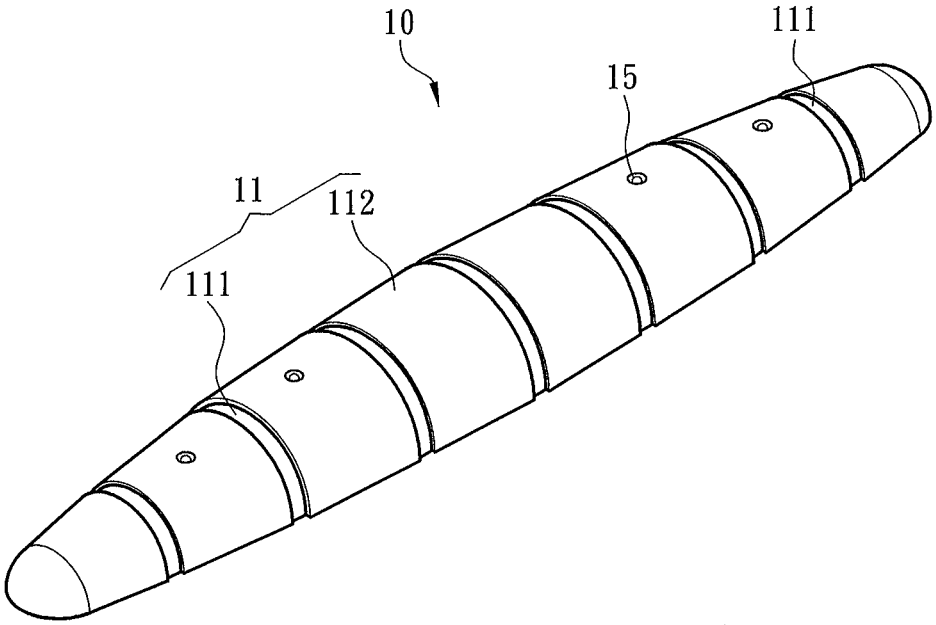
FIG. 5 is a perspective view of a third embodiment of the throat vibration audio wireless transmission apparatus of the invention.

Please refer to FIG. 5 for a third embodiment of the invention. It is substantially constructed like the first embodiment previously discussed. The main difference is that the body 10 includes at least one LED 15 to provide light for alert and illumination. The LED 15 is electrically connected to the control circuit board 22 and controlled thereof to function as an alert light or illumination light, such as an indicator light for battery charging or night light, indictor light for signal transmission, etc. It is to be noted that the number and embodiment style of the LED 15 is not limited to the one previously discussed. The embodiment serves merely for illustrative purpose and is not the limitation of the invention.

As a conclusion, the throat vibration audio wireless transmission apparatus of the invention mainly includes a body, a throat vibration detection module located at one end of the body and a wireless transmission module installed in the body. The body includes a cap, a flexible base coupled with the cap and a deformation holding member on the flexible base. The cap includes a plurality of cover portions and at least one elastic bending portion bridging two neighboring cover portions. The deformation holding member can be pushed by forces to make two ends thereof move towards the center to form an arched shape and drive the flexible base and the cap to bend to allow the elastic bending portion to extend towards the cover portions at two sides thereof. The throat vibration detector detects a vibration wave and converts to an electric signal which is received by the control circuit board of the throat vibration detection module and converted to a audio signal, which in turn is transmitted by the wireless transmission module. The apparatus thus formed can be adjusted according to a user's neck and attached thereon closely to receive sound without interference of environment. It also can be moved according to user's requirements or desired locations in a wireless fashion, thus can greatly improve the usability and convenience.

While the preferred embodiments of the invention have been set forth for the purpose of disclosure, they are not the limitation of the invention, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A throat vibration audio wireless transmission apparatus, comprising:

a body including a cap, a flexible base coupled with the cap and a deformation holding member on the flexible base; the cap including a plurality of cover portions and at least one elastic bending portion bridging two neighboring cover portions, the deformation holding member including a release state without receiving forces to bend and a bending state in which the deformation holding member is pushed by the forces to make two ends thereof move towards the center to form an arched shape and drive the flexible base and the cap to bend to allow the elastic bending portion to extend towards the cover portions at two sides thereof;

a throat vibration detection module including a throat vibration detector located at one end of the body and a control circuit board installed in the body and electrically connected to the throat vibration detector, the throat vibration detector detecting a vibration wave and converting to an electric signal which is received by the control circuit board and converted to an audio signal; and a wireless transmission module installed in the body and electrically connected to the control circuit board to transmit the audio signal converted by the control circuit board.

2. The throat vibration audio wireless transmission apparatus of claim 1 further including a battery installed in the body to provide power for the control circuit board.

3. The throat vibration audio wireless transmission apparatus of claim 1, wherein the body includes a Universal Serial Bus located at another end opposite to the throat vibration detector and electrically connected to the control circuit board to allow the throat vibration audio wireless transmission apparatus to connect with an external electronic device.

4. The throat vibration audio wireless transmission apparatus of claim 1, wherein the body includes an audio output port electrically connected to the control circuit board to get the audio signal.

5. The throat vibration audio wireless transmission apparatus of claim 1, wherein the body holds at least one earphone electrically connected to the control circuit board for broadcasting.

6. The throat vibration audio wireless transmission apparatus of claim 1, wherein the body includes at least one light emitting diode electrically connected to the control circuit board to provide light for alert and illumination.

7. The throat vibration audio wireless transmission apparatus of claim 1, wherein the control circuit board includes a memory unit to save the audio signal.

8. The throat vibration audio wireless transmission apparatus of claim 1, wherein the control circuit board is a flexible printed circuit board.

* * * * *